United States Patent [19]

Bugin, Jr. et al.

[11] Patent Number: 5,005,550

[45] Date of Patent: Apr. 9, 1991

[54] CANISTER PURGE FOR TURBO ENGINE

[75] Inventors: Marion Bugin, Jr., Troy; Gary D. Dawson, Rochester, both of Mich.; Kerry D. Franks, Lafayette, Colo.; Richard O. Geiss, Dexter; Donald H. Kerska, Royal Oak, both of Mich.

[73] Assignee: Chrysler Corporation, Highland Park, Mich.

[21] Appl. No.: 452,433

[22] Filed: Dec. 19, 1989

[51] Int. Cl.[5] ..... F02M 25/08

[52] U.S. Cl. ..... 123/520

[58] Field of Search ..... 123/518-520

[56] References Cited

U.S. PATENT DOCUMENTS

| | | | |
|---|---|---|---|
| 4,070,828 | 1/1978 | Barres | 60/274 |
| 4,193,383 | 3/1980 | Rogers | 123/520 |
| 4,446,940 | 5/1984 | Sakakibara | 123/559 |
| 4,530,210 | 7/1985 | Yamazaki | 60/605 |
| 4,541,396 | 9/1985 | Sato | 123/518 |

OTHER PUBLICATIONS

Defensive Publication Ser. No. 775,389, Hansen, Apr. 1, 1969.

*Primary Examiner*—Tony M. Argenbright
*Attorney, Agent, or Firm*—Kenneth H. MacLean, Jr.

[57] ABSTRACT

An improved fuel vapor purging system for a vehicle vapor storage canister associate with a positively charged engine such as a turbocharged or supercharged engine. An aspirator device is utilized to provide a pressure differential with respect to atmosphere so as to draw air through the canister for purging.

6 Claims, 1 Drawing Sheet

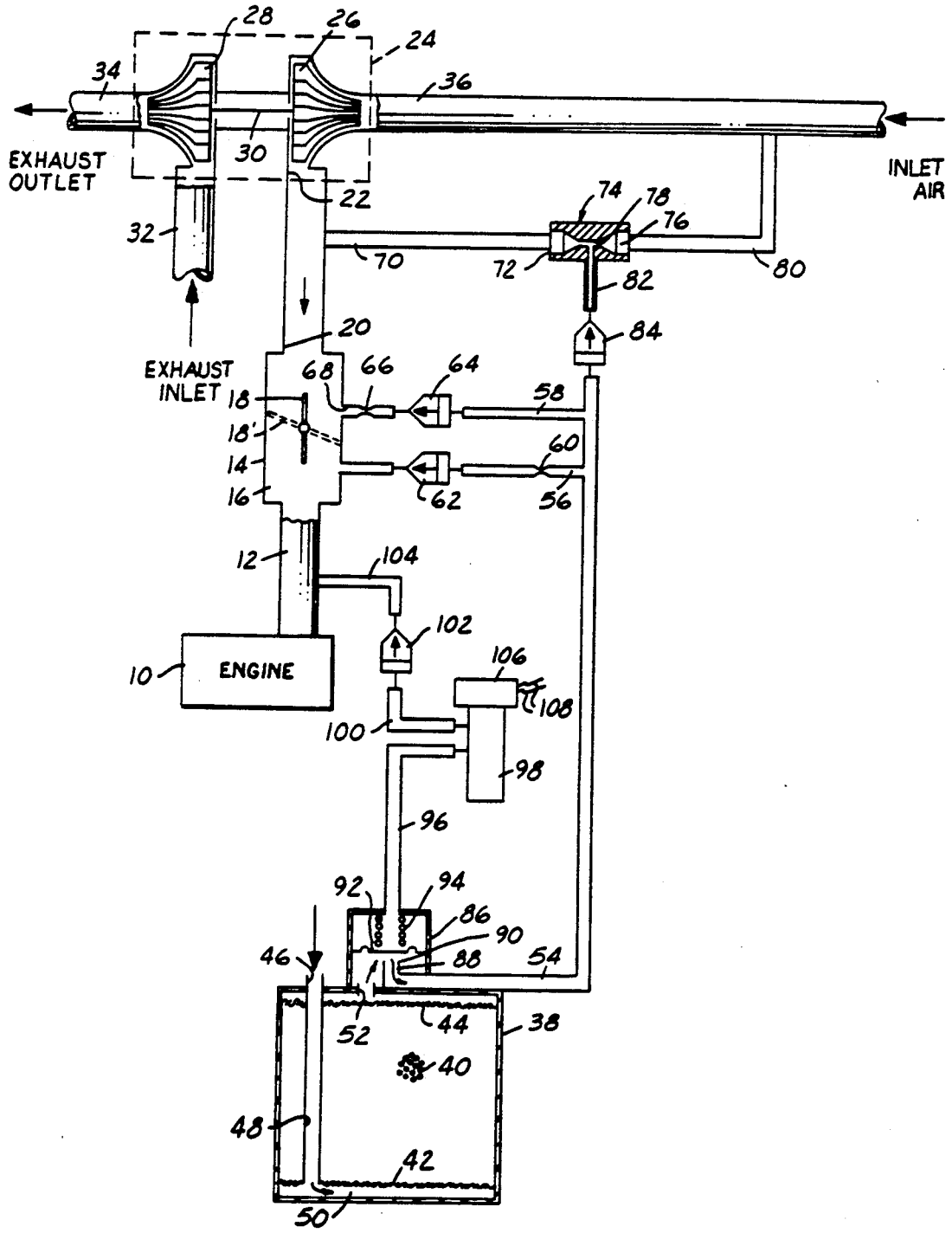
EXHAUST OUTLET
INLET AIR
EXHAUST INLET
ENGINE
28
26
24
34
36
30
22
32
74
78
76
70
72
80
82
84
20
68
66
64
58
18
18'
14
16
60
62
56
12
104
102
10
106
108
100
98
96
92
94
86
90
46
88
54
52
44
38
40
48
42
50

CANISTER PURGE FOR TURBO ENGINE

BACKGROUND OF THE INVENTION

1. Field of Invention

This application describes a vapor purge system for a vapor storage canister used with a turbocharged internal combustion engine which utilizes an aspirator device to generate vacuum pressure used for inducing air flow through the canister during a boost condition.

2. Description of the Related Art

Fuel emission control systems for automobiles now utilize a fuel vapor storage canister to temporarily store fuel vapor. These vapors are collected and stored in the canister during certain periods such as when the vehicle is inoperative or when the catalyst converter is too cool to effectively operate. The vapors are selectively directed to the combustion chamber for burning during other periods by drawing air from the atmosphere through the canister during what may be referred to as a purging operation.

With normally aspirated engines, fuel vapors are purged from the canister by utilizing the intake manifold's vacuum pressure to draw air through the canister. With turbocharged engines, there is often a positive manifold pressure generated during boost and thus there is not a vacuum to draw air through the canister. Therefore, it is necessary to provide means to produce an air moving pressure differential with atmosphere so that air can be drawn through the canister to purge fuel vapors therefrom.

The U.S. Pat. Nos. 4,070,828; 4,193,383; 4,446,940; 4,530,210 and 4,541,396 all generally discloses emission systems for engines. The two later patents provide for canister suction action during a supercharging operation. However, none disclose the use of an aspirator to provide a vacuum differential pressure like the subject application.

SUMMARY OF THE INVENTION

The subject emission control system utilizes a canister to temporarily store fuel vapors. A vacuum pressure differential is used to draw air through the canister and into the engine during a purging operation. Since a supercharged or a turbocharged engine does not generate a vacuum condition in the engine's manifold during boost, the emission system provides aspirator means to create a vacuum condition with respect to atmosphere and thus facilitates the purging of the canister even during boost.

BRIEF DESCRIPTION OF THE DRAWING

The sole figure is a somewhat schematic view of a turbocharged engine's emission storage and purge system.

DETAILED DESCRIPTION OF AN EMBODIMENT

In the drawings, a fuel vapor emission system in association with a vehicle engine is illustrated. An engine 10 is shown schematically. Engine 10 also has an air intake system including a manifold 12 and a throttle body or housing 14. The throttle body 14 has an air passage 16 therethrough and a pivotal throttle blade 18 to control the quantity of air flowing into the manifold 12. Throttle body 14 has an inlet 20 fluidly connected to an outlet 22 of a turbocharger assembly 24.

The turbocharger assembly 24 is shown schematically. As is conventional it includes a rotating compressor wheel 26 in one part of a housing and a rotating turbine wheel 28 in another part of the housing. The compressor 26 and turbine 28 are each mounted upon a common shaft 30 for rotation together. The shaft 30 and wheels 26, 28 are rotated by routing engine exhaust gas through the turbine 28. Specifically, exhaust gases are directed through a tube 32 to the radially edge portion of a wheel 28. The gases then pass inwardly and axially to be discharged through an outlet tube 34. In passage, the gases transfer heat energy into rotative energy of the turbine wheel 28, shaft 30 and, more usefully, compressor wheel 26.

The compressor wheel 26 receives air from an inlet tube 36 which is aligned axially with the compressor wheel 26. As the air is pumped axially and radially outwardly, it is compressed or pressurized. The pressurized air is discharged from the compressor 26 into the outlet 22 of the turbocharger assembly. Hence the air flows through the throttle body 14 into the manifold 12 and the engine 10.

The above description is of a turbocharged internal combustion engine commonly used in automobiles manufactured at the present time by Chrysler Corporation as well as others. A variation of the turbo charged engine is a supercharged engine. In the supercharged engine, a compressor wheel or the like is utilized to pressurize intake air for the engine. However, instead of using the heat energy of the exhaust gases as in the turbocharger described above, the supercharger compressor is rotated by connection to the engine's crankshaft or other rotative shaft. The resultant pressurized intake air is similar. In either situation, the air pressure in the manifold is positive rather than a vacuum during periods when the compressor is effective.

Modern engines are required to emit very limited quantities of fuel vapor to the atmosphere. Modern automobiles have vapor emission control systems and apparatus for this purpose. Common to all known systems is a fuel vapor storage canister 38 shown in the drawing. The vapor storage canister 38 is a hollow container for a quantity of activated charcoal particles 40 or the like. Activated charcoal has the property of absorbing fuel vapor molecules and "storing" them for a period of time. In a preferred vapor storage canister as shown in the drawing, the charcoal particles are secured between a lower screen 42 or the like an upper screen 44 or the like. Fuel vapors and air are routed to the interior of the canister 38 through conduit and an inlet (not shown). In the process, the fuel vapor molecules are entrapped and held by the activated charcoal particles 40.

The canister 38, and specifically the charcoal 40 has a limited storage capacity of fuel vapor. Therefore, it is necessary either periodically or continually to remove vapor molecules from the charcoal. This process is commonly referred to as purging the canister. Commonly, this is done by drawing air from atmosphere into the canister and through the activated charcoal. Resultantly, the air picks up molecules of fuel vapor. The air then is drawn into the engine combustion chambers and is burned. An air inlet 46 is provided to allow purge air to enter the canister 38. In the illustrated embodiment, Air from the inlet passes downward through a tube 48 to a space 50 beneath the screen 42 and above the bottom of the canister 38. The space 50 allows the even distribution of the air so that all the charcoal is evenly purged of fuel molecules.

The canister also has an outlet opening 52 at the other end of the charcoal mass 40 to allow the purge air to be discharged from the canister 38. Normally, purge air and fuel vapor picked up from the charcoal pass through a conduit 54 to either of conduits 56 or 58. When the engine is at idling, the throttle blade assumes the position 18' and the interior of throttle body 14 downstream of the blade 18' is at a strong negative pressure or a vacuum. During this period, purge air is drawn from conduit 56 through an orifice 60, a one way check valve 62 into the throttle body and hence into the engine 10. The orifice 60 is provided to limit the quantity of purge air entering the engine during idle. Too much air will interfere with desired engine idling. The one way check valve 62 prevents air from flowing out of the throttle body 14 if a negative pressure differential were to be generated thereacross.

When engine 10 is operating at part throttle with the throttle blade being pivoted between the idle position 18' and the wide open throttle (WOT) 18, the portion of throttle body 14 upstream of blade 18 is exposed to manifold vacuum pressure. This vacuum induces air flow through conduit 58, one way check valve 64, an orifice 66 and port 68 into the throttle body. The purge flow is influenced by the relative position of the blade 18 to the port 68 and by the size of the orifice. The orifice 66 limits the purge air flow into the engine as required for good operation. The one way check valve 64 prevents air flow from the throttle body 14 in the event that a negative pressure differential is generated thereacross.

When the engine is operating under boost conditions, the compressor generates a greater pressure at the outlet 22 of the turbocharger 24 than at the inlet 36. Usually, the engine controls are setup so that boost occurs when the throttle blade rapidly opens to approach or is in the WOT position 18. Under these conditions, the compressor 26 generates a positive pressure in the throttle body 14 and in manifold 12. Check valves 62, 64 prevent any air flow from the throttle body 14. However, the positive pressure at outlet 22 cause air to flow through a conduit 70 to the inlet end portion 72 of an aspirator device 74. The aspirator device consists of a housing defining inlet end portion 72, outlet end portion 76 and a reduced dimension passage 78 therebetween. The air passes from inlet 72 through reduced dimension passage 78 to the outlet 76 and then through a conduit 80 to inlet 36 of the compressor 26. The flow of air through passage 78 reduces its pressure in accord with known principles.

The aspirator device 74 also includes a purge air passage 82 which extends substantially normally to the passage 78 and opens thereto. The conduit 54 is connected to the purge air passage of aspirator 74. A one way check valve 84 allows the flow of air and vapors from conduit 54 into the passage 82 and then into passage 78. Finally, the purge air and vapor pass through conduit 70 into the throttle body 14 and then to the engine. During non-boost operation of the engine, the check valve 84 prevents air flow from the aspirator back to the canister 38.

The above described emissions control operates effectively to route purged vapors to the engine for burning and treatment by a catalyst converter (not shown). However, under certain conditions, it is undesirable to purge the canister. For example, when the catalyst converter is too cool to be effective in converting exhaust gases, provision is made to prevent canister purging. A control valve 86 is imposed after the outlet 52 from the canister 38. Valve 86 could be a separate device with a separate housing but it is preferred that it be integrated with the canister as shown. Valve 86 has an outlet port 88 formed by a valve seat 90. A movable valving member such as a diaphragm 92 is normally positioned by a spring 94 against the seat 90 so that air cannot flow through the valve 86. This is the condition of the valve when no purge is desired as mentioned above.

When air flow through the valve 86 is desired, a negative (vacuum) pressure is introduced into the valve 86 above the diaphragm 92 which unblocks the port 88. Vacuum is directed to the valve 86 through a conduit 96 which is connected to a port of a solenoid controlled on-off valve 98. Another port of the valve 98 is connected to a conduit 100. In turn, the conduit 100 is connected to a one way check valve 102 which is connected to a conduit 104. An electric solenoid portion 106 of the valve 98 controls opening of the valve 98. When open, vacuum is routed to the space above diaphragm 92 thus allowing purging. When closed, no vacuum is routed to the space above the diaphragm and the port 88 is blocked thus preventing purging of the canister. The solenoid 106 is energized through wires 108 which connect to the engine electronic control unit (ECU). An example of when no purge is desirable is when the catalyst converter is too cool to be effective.

The system and embodiment which has been described and illustrated in the drawing is somewhat schematic and the system would work with other components and arrangements. It should be clear that modifications may be made without falling outside the scope of the invention as claimed hereafter.

We claim:

1. With a vehicle engine which does not generate vacuum in a intake manifold under some operative conditions and utilizing an air compressor, an improved fuel vapor purge system for a vapor storage canister of the type utilizing a vacuum pressure differential to draw air through the canister, comprising: an air inlet to admit air to the canister; an air and vapor outlet to discharge air and vapor from the canister; an aspirator device including a housing having an inlet portion, an outlet portion, and a reduced dimension passage therebetween; means connecting the aspirator's inlet portion to the outlet region of the air compressor and the aspirator's outlet portion to the inlet region of the air compressor so that pressurized air is passed through the reduced dimension passage; the aspirator also having a purge passage connected to the air and vapor outlet of the canister and opening to the aspirator's reduced dimension passage whereby compressed air flowing through the aspirator's reduced dimension passage draws air through the canister so that fuel vapors are also drawn into the aspirator and then through the compressor and into the engine.

2. The improved purge system set forth in claim 1 in which a one way flow valve is positioned between the aspirator's purge passage to only allow air flow from the canister to the aspirator and not in an opposite direction.

3. The improved purge system set forth in claim 1 in which a control valve means is positioned to selectively permit or prevent air and vapor flow discharge from the canister.

4. An improved automobile engine emission control system with a canister to temporarily store fuel vapors in a canister and means to subsequently purge the canister of the vapors by drawing atmospheric air through the canister and into the engine under the influence of a vacuum pressure, the engine being capable of being positively charged with air by a compressor during which operation no vacuum is generated by the engine, comprising: an air inlet to admit air to the canister; an air and vapor outlet to discharge air and vapor from the canister; an aspirator device including a housing having an inlet portion, an outlet portion, and a reduced dimension passage therebetween; means connecting the aspirator's inlet portion to the outlet region of the air compressor and the aspirator's outlet portion to the inlet region of the air compressor so that pressurized air is passed through the reduced dimension passage; the aspirator also having a purge passage connected to the air and vapor outlet of the canister and opening to the aspirator's reduced dimension passage whereby compressed air flowing through the aspirator's reduced dimension passage draws air through the canister so that fuel vapors are also drawn into the aspirator and then through the compressor and into the engine.

5. The improved system set forth in claim 4 in which a one way flow valve is positioned between the aspirator's purge passage to only allow air flow from the canister to the aspirator and not in an opposite direction.

6. The improved system set forth in claim 4 in which a control valve means is positioned to selectively permit or prevent air and vapor flow discharge from the canister.

* * * * *

UNITED STATES PATENT AND TRADEMARK OFFICE

CERTIFICATE OF CORRECTION

PATENT NO. : 5,005,550

DATED : April 9, 1991

INVENTOR(S) : M. Bugin, Jr., et al.

It is certified that error appears in the above-identified patent and that said Letters Patent is hereby corrected as shown below:

Column 2, line 44, after "activated", insert--carbon or--

Column 3, line 23, for "upstream", substitute--downstream--

Column 3,line 60, for "70", substitute--80 to the inlet 36 and then--

Column 3, line 63, after "38", add--or throttle body 14--

Signed and Sealed this

Thirteenth Day of October, 1992

*Attest:*

DOUGLAS B. COMER

*Attesting Officer*

*Acting Commissioner of Patents and Trademarks*